US011417305B2

(12) United States Patent
Brogan et al.

(10) Patent No.: US 11,417,305 B2
(45) Date of Patent: Aug. 16, 2022

(54) ENHANCED HOUR-GLASS TRANSDUCER

(71) Applicant: Raytheon Company, Waltham, MA (US)

(72) Inventors: Patrick M. Brogan, Bristol, RI (US); Daniel Brogan, Bristol, RI (US); John C. Cochran, Portsmouth, RI (US)

(73) Assignee: Raytheon Company, Waltham, MA (US)

( * ) Notice: Subject to any disclaimer, the term of this patent is extended or adjusted under 35 U.S.C. 154(b) by 239 days.

(21) Appl. No.: 16/374,286

(22) Filed: Apr. 3, 2019

(65) Prior Publication Data

US 2020/0320969 A1 Oct. 8, 2020

(51) Int. Cl.

| | |
|---|---|
| ***G10K 9/12*** | (2006.01) |
| ***H04R 1/44*** | (2006.01) |
| ***B06B 1/06*** | (2006.01) |

(52) U.S. Cl.

CPC ..... *G10K 9/121* (2013.01); *B06B 1/0633* (2013.01); *H04R 1/44* (2013.01)

(58) Field of Classification Search

CPC ..... G10K 9/121; G10K 9/125; B06B 1/0633; H04R 1/44

See application file for complete search history.

(56) References Cited

U.S. PATENT DOCUMENTS

| | | | | |
|---|---|---|---|---|
| 4,802,490 | A * | 2/1989 | Johnston | A61B 8/06 600/454 |
| 4,922,470 | A | 5/1990 | McMahon et al. | |
| 5,136,556 | A * | 8/1992 | Obara | B06B 1/0611 310/337 |
| 5,262,696 | A * | 11/1993 | Culp | H01L 41/0926 310/328 |
| 5,805,529 | A | 9/1998 | Purcell | |
| 6,535,459 | B1 * | 3/2003 | Hutton | G10K 9/121 367/163 |
| 6,643,222 | B2 | 11/2003 | Osborn et al. | |
| 7,457,199 | B2 * | 11/2008 | Purcell | G10K 9/121 367/163 |
| 2003/0128628 | A1 * | 7/2003 | Osborn | H04R 17/00 367/163 |
| 2003/0160546 | A1 * | 8/2003 | Osborn | B06B 1/0603 310/369 |
| 2005/0152222 | A1 | 7/2005 | Kaufman et al. | |

FOREIGN PATENT DOCUMENTS

| | | | |
|---|---|---|---|
| EP | 0903725 | A2 | 3/1999 |

OTHER PUBLICATIONS

International Search Report and Written Opinion of the International Searching Authority dated Jun. 22, 2020 in connection with International Patent Application No. PCT/US2020/022444, 13 pages.

* cited by examiner

*Primary Examiner* — Ian J Lobo

(57) ABSTRACT

An hourglass transducer including a longitudinal driver, a shell, and a pair of endcaps is provided. The driver drives the transducer. The pair of endcaps is attached to ends of the driver and cap the shell enclosing the transducer. The shell includes a first shell end, a second shell end, and a pleated geometry. The first shell end and second shell end are structured with circular cross sections. The pleated geometry is between the first shell end and the second shell end. A perimeter of the pleated geometry is the same as perimeters of the circular cross sections of the first shell end and the second shell end.

20 Claims, 6 Drawing Sheets

600

601

ENHANCED HOUR-GLASS TRANSDUCER

TECHNICAL FIELD

This disclosure is directed in general to manufacture of transducers. More specifically, this disclosure relates to a system and method for an enhanced hour-glass transducer.

BACKGROUND

Hour-Glass type transducers are a variant of what has more commonly been referred to as Barrel-Stave transducers which have previously required multi-piece shells and are inherently more complex to build. Multi-piece shells also cannot be made water tight without the application of an elastomeric boot. A boot is subject to high rates of wear due to the action of the multi-piece shell, making the multi-piece shell much less reliable than desired.

SUMMARY

This disclosure provides a system and method for an enhanced hour-glass transducer.

In a first embodiment, an enhanced hour-glass shell includes a first shell end, a second shell end, and a pleated geometry. The first shell end and second shell end are structured with circular cross sections. The pleated geometry is between the first shell end and the second shell end. A perimeter of the pleated geometry is the same as perimeters of the circular cross sections of the first shell end and the second shell end.

In a second embodiment, an hourglass transducer includes a driver, a shell, and a pair of endcaps. The driver drives the transducer. The pair of endcaps is attached to ends of the driver and caps the shell enclosing the transducer. The shell includes a first shell end, a second shell end, and a pleated geometry. The first shell end and second shell end are structured with circular cross sections. The pleated geometry is between the first shell end and the second shell end. A perimeter of the pleated geometry is the same as perimeters of the circular cross sections of the first shell end and the second shell end.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
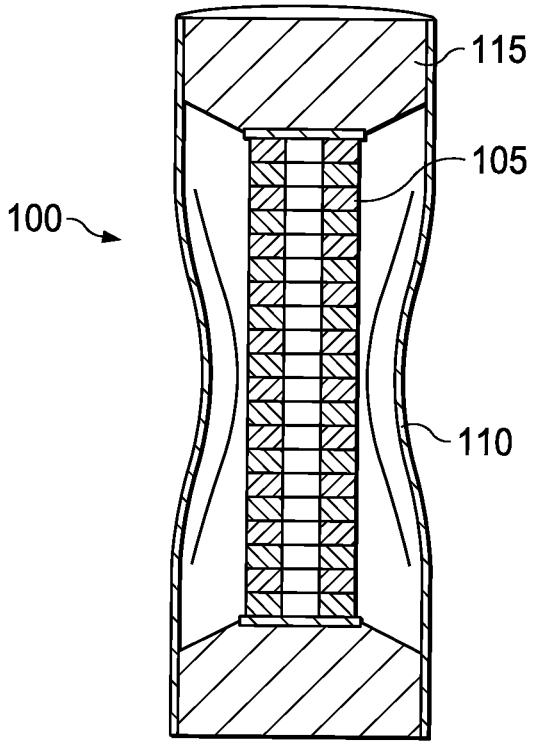
FIG. 1 illustrates an example enhanced hour-glass transducer according to this disclosure, shown in simplified, cross-sectional view.

FIGS. 1 through 6E, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

For simplicity and clarity, some features and components, such as wiring, connectors, seals, etc. are not explicitly shown in every figure, including those illustrated in connection with other figures. It will be understood that all features illustrated in the figures may be employed in any of the embodiments described. Omission of a feature or component from a particular figure is for purposes of simplicity and clarity and not meant to imply that the feature or component cannot be employed in the embodiment(s) described in connection with that figure.

It will be understood that embodiments of this disclosure may include any one, more than one, or all of the features described here. Also, embodiments of this disclosure may additionally or alternatively include other features not listed here. While the disclosed embodiments are described with respect to hourglass transducers, these embodiments are also applicable in any other suitable systems or applications.

The enhanced hour-glass (HG) transducer is an original and innovative approach for the design of the transducer shell. The enhanced shell solves the problem of creating a one piece flexural shell that generates highly efficient velocity transformation needed in the HG concept, and permits simplified assembly of the transducer, along with automatic water tight integrity without a boot or other covering.

Prior attempts to construct an HG type transducer have all required multi-piece shells which are inherently more complex to build and cannot be made water tight without the application of an elastomeric boot, where the boot is subject to high rates of wear due to the action of the multi-piece shell, making the prior attempts much less reliable than the enhanced HG transducer shell disclosed here.

The enhanced HG transducer shell relies on an innovative combination of geometric and material properties to enable the characteristic motion of the HG shaped transducer. In the disclosed embodiments, innovative combinations of pleated/corrugated undulations in the shell's surface provide an original approach to generating the overall shape and highly anisotropic composite material properties enable extremely efficient velocity profiles characteristic of the HG transducer. Because the shell is a one piece composite structure, transducer assembly is greatly simplified and water tight integrity is automatic. Finite Element Analysis (FEA) has been conducted to show the highly effective velocity profiles that result.

The flexural compliance of the shell is achieved using pleated geometry and composite materials. Composite material is arranged in a manner that the shell exhibits high stiffness in the axial direction and very low stiffness in the circumferential direction. The presence of the pleats/corrugations contributes additional circumferential compliance critical to efficient operation. The overall shape of the shell in the longitudinal cross section is based on a catenary or portion of a circular arc type geometry that permits optimization of the velocity transformation properties of the shell. The number of pleats is optional, with 12 pleats shown in the example depicted in the figures, however, the design is not dependent on a specific number of pleats. A highly novel approach to combining these geometric features, constant perimeter swept surfaces is applied, which automatically controls the depth of the pleats.

FIG. 1 illustrates an example enhanced hour-glass transducer 100 according to this disclosure. The embodiment of the enhanced hour-glass transducer 100 illustrated in FIG. 1 is for illustration only. FIG. 1 does not limit the scope of this disclosure to any particular implementation.

The HG transducer 100 is an hourglass-shaped flextensional transducer using a longitudinal driver 105, which may be embodied using piezo-electric ceramic, textured ceramic, magneto-strictive rare earth, hydraulic or any number of other length expander drivers known to those skilled in the general art of transducer design. The HG transducer includes the longitudinal driver 105, an HG shell 110, and a pair of end caps 115. The HG shape as described in these embodiments is efficient due to nearly 100% positive volume flow. The HG shape is conducive to maintaining compressive loading on the driver, because increasing depth positively loads the HG shell 110 and longitudinal driver 105.

The longitudinal driver 105 may be comprised of any longitudinal actuator such as a stack of ferro-electric ceramics or piezoelectric material, hydraulic driver, magneto-strictive driver or textured ceramic, which is a class of piezoelectric ceramic. The longitudinal driver 105 is disposed along the main axis of the HG shell 110. The main axis runs in a direction that goes through the center of the cross sections of both end caps 115. The longitudinal driver 105 expands and contracts in the axial direction, pushing apart and pulling together the end caps 115 in a cyclical fashion. This oscillating change in lengths drives the end caps and the end caps pull on the shell.

Figure 2:
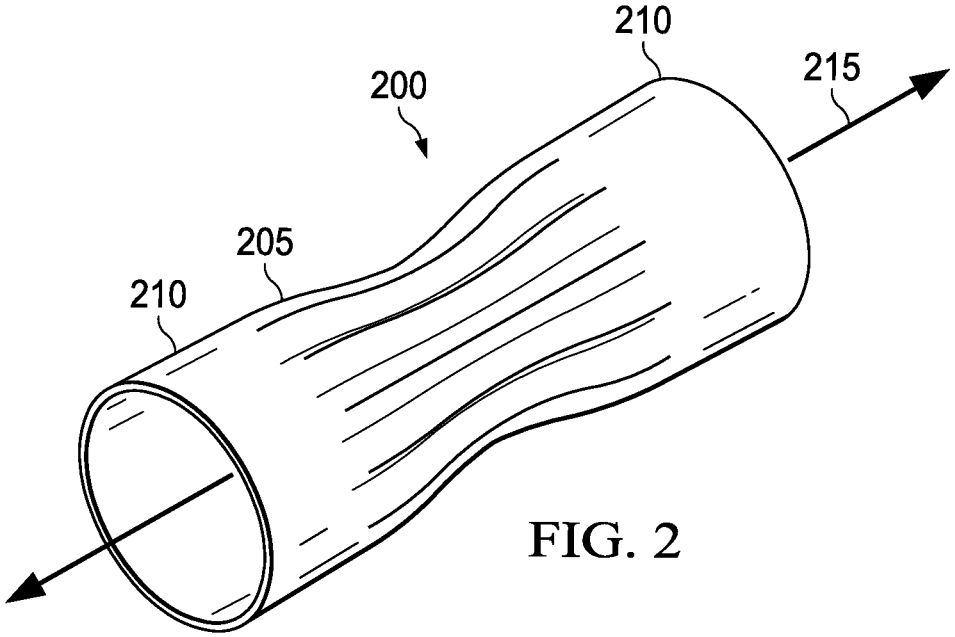
FIG. 2 illustrates an example hour-glass shell according to this disclosure.

FIG. 2 illustrates an example hour-glass shell 200 according to this disclosure. The embodiment of the hour-glass shell 200 illustrated in FIG. 2 is for illustration only. FIG. 2 does not limit the scope of this disclosure to any particular implementation.

The HG shell 200 is a protective layer for a textured ceramic driver. The HG shell 200 achieves equivalent acoustic volume flow efficiency with a single part and does not require a waterproof boot. The HG shell 200 includes a pleated geometry 205 between two shell ends 210. The shell ends 210 do not include the pleated geometry 205. The perimeter of the shell in a plane perpendicular to the main axis 215 is constant through the length along the main axis 215. The perimeter of either the shell's inner or outer surface can be constant. With the thickness of the shell being constant, when the perimeter of the shell's inner surface, for example, being consistent would cause the perimeter of the shell's outer surface to slightly change based on the thickness and shape. The same is true of the perimeter of the inner surface when the outer surface is held constant. In certain embodiments, a perimeter of a middle of the thickness is held constant to reduce the slight variance caused by the thickness. That is, when the perimeter is considered from the center of the thickness of the shell, any changes realized by the thickness is minimalized and reduced between the inner surface and the outer surface.

Making the HG shell 200 out of metal or plastic would cause the HG shell to not function acoustically. For the HG shell 200 to function acoustically, a composite with an in-plane stiffness in the direction that forms the axis is approximately ten times greater than the stiffness in the direction that forms the circumference or along the perimeter of the HG shell 200. When using a composite layup, such as a fiberglass or graphite fibers, the directions of the fibers are oriented and the dominant orientation in the axial direction has an approximate 10:1 stiffness ratio for the stiffness in the axial direction compared to a stiffness in the circumferential direction.

Figure 3A:
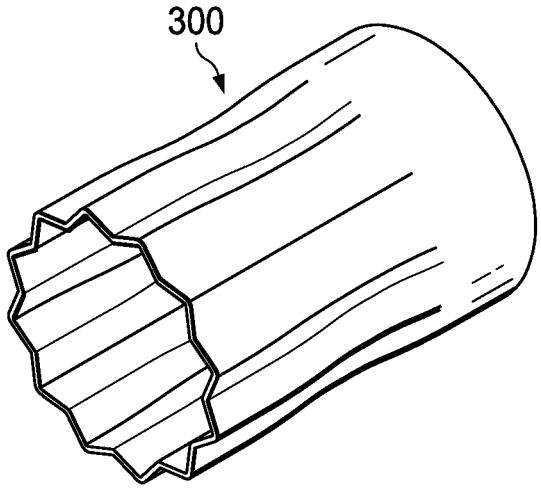
FIGS. 3A and 3B illustrate examples (exaggerated for clarity) of a stretched HG shell (sectioned view) and a contracted HG shell (sectioned view) according to this disclosure.
Figure 3B:
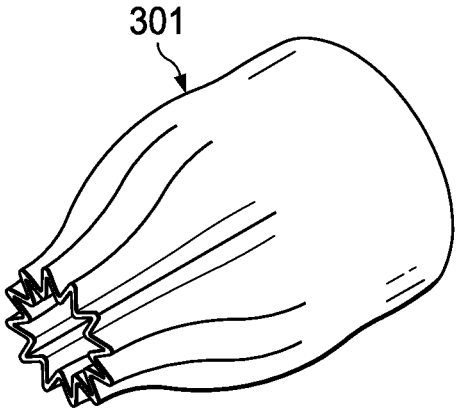

FIGS. 3A and 3B illustrate examples of a stretched HG shell 300 and a contracted HG shell 301 according to this disclosure. The embodiments of the stretched HG shell 300 and the contracted HG shell 301 illustrated in FIGS. 3A and 3B are for illustration only. FIGS. 3A and 3B do not limit the scope of this disclosure to any particular implementation.

The stretched HG shell 300 occurs when the endcaps are pushed apart and the contracted HG shell 301 occurs when the end caps are pulled together. "Gamma" is defined as a ratio of radial breathing mode. Gamma is measured as a ratio of radial expansion at the midsection to the axial expansion at one of the endcaps. For example, a gamma of 0.5 would mean that the radial expansion is half the distance compared to the axial expansion. Optimized acoustic performance is achieved when the gamma value is greater than 1.0 and for a well optimized design, gamma may be expected to exceed 3.0.

Figure 4A:
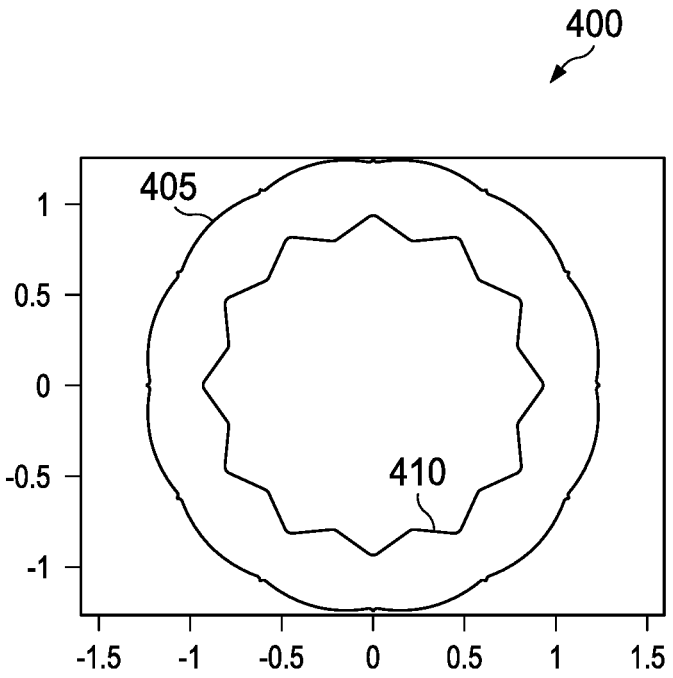
FIGS. 4A and 4B illustrate an example graph of an HG midsection modal displacement (exaggerated) and an example graph of an HG catenary shape according to this disclosure.
Figure 4B:
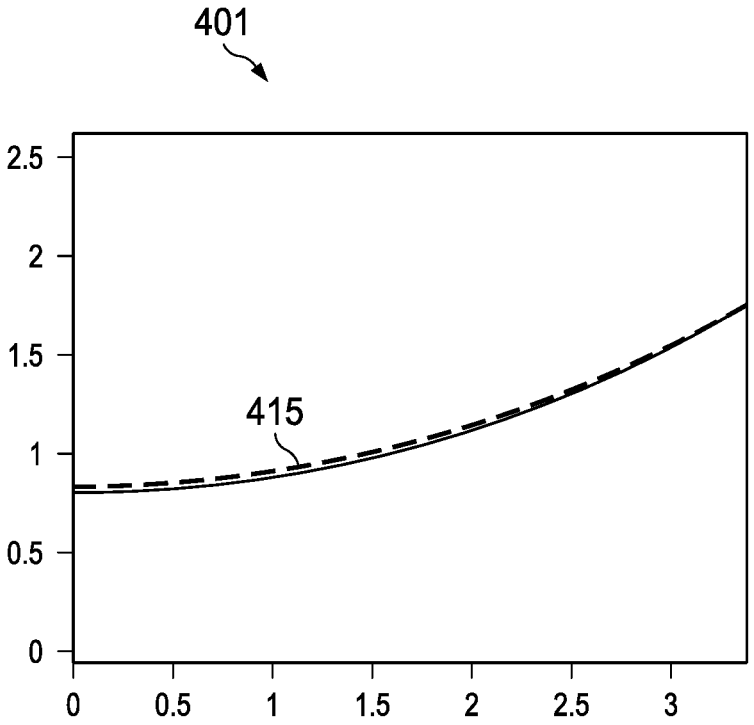

FIGS. 4A and 4B illustrate an example graph 400 of an HG midsection and an example graph 401 of an HG catenary shape according to this disclosure. The embodiments of the graph 400 of the HG midsection and the graph 401 of the HG catenary shape illustrated in FIGS. 4A and 4B are for illustration only. FIGS. 4A and 4B do not limit the scope of this disclosure to any particular implementation.

The HG midsection graph 400 illustrates the diameter of the shell at the midriff or center plane. The HG midsection graph 400 represents the cross section at the center plane of the HG shell. The HG midsection graph 400 includes a deformed or an expanded midsection 405 and an un-deformed or a contracted midsection 410. The HG catenary graph 401 illustrates the diameter of the shell starting from the midsection of the shell to the end of the shell.

These HG midsection graph 400 and HG catenary graph 401 illustrate the change between the un-deformed shell and the deformed shell using an isotropic shell. The isotropic shell exhibits a very small ratio of midriff (midsection) expansion to axial end displacement, for the mode of interest. The ratio illustrated in FIGS. 4A and 4B is too small to be of use in acoustic radiation. An orthotropic shell exhibits almost nine times the midriff expansion of the isotropic shell, but the absolute value of the expansions is only 16.3% of the ratio for a pure catenary shape change. There is a possibility that further optimization can be achieved with a different pleated geometry.

The shape in FIG. 4A is exaggerated, but shows a deformed condition where the shape is favorable to volume flow at the midriff. The modal ratio of midriff radial expansion to axial displacement is approximately 0.35. Illustrated in FIG. 4B is a pure catenary of constant length and of a same curvature as the FEA model. When pulled axially 0.010000" at both ends, the midriff rises at the center by 0.2762, thus achieving a ratio of 2.76.

A pure catenary is similar to a chain supported at both ends and drooping in the middle. FIG. 4B illustrates half of a catenary 415 from the center to one of the supports. As the catenary 415 is pulled apart by the supports, the droop at the center decreases, up to a straight line. As the catenary 415 is relieved of the pulling by the supports, the droop at the center returns back to the initial position.

Figure 5A:
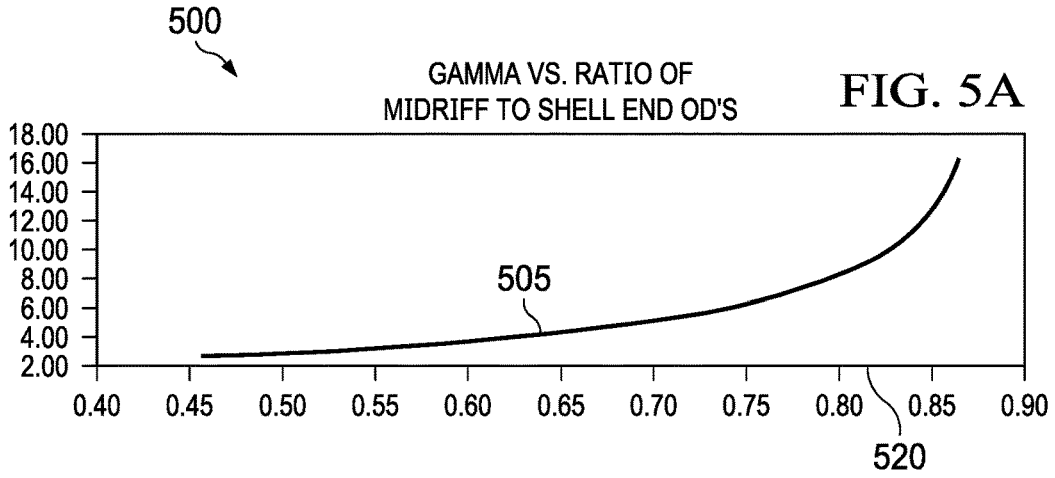
FIGS. 5A, 5B and 5C illustrate an example graph of gamma compared to a ratio of initial midriff radius to shell end outer diameter (droop ratio), an example graph of an force generation area compared to the droop ratio, and an example graph of a catenary stretching force compared to the droop ratio according to this disclosure.
Figure 5B:
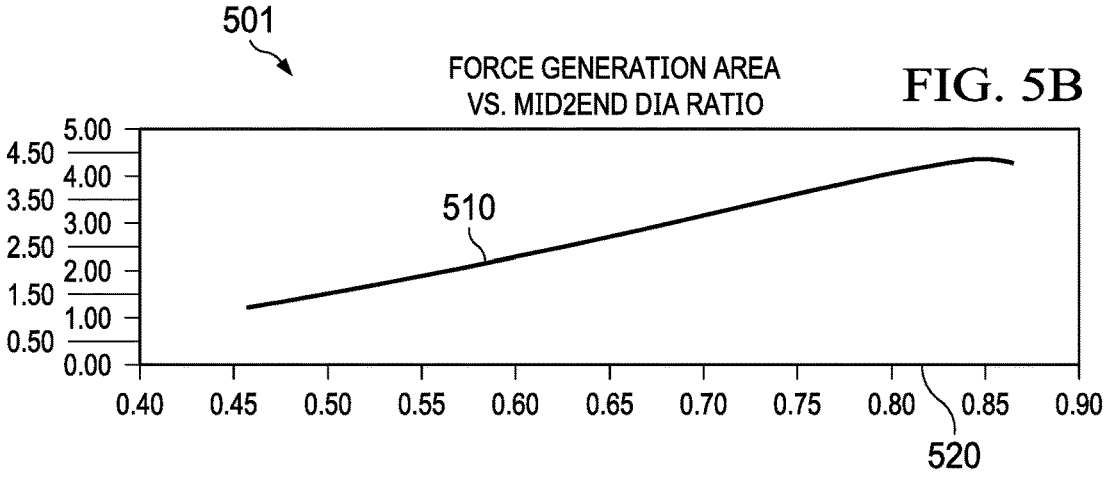
Figure 5C:
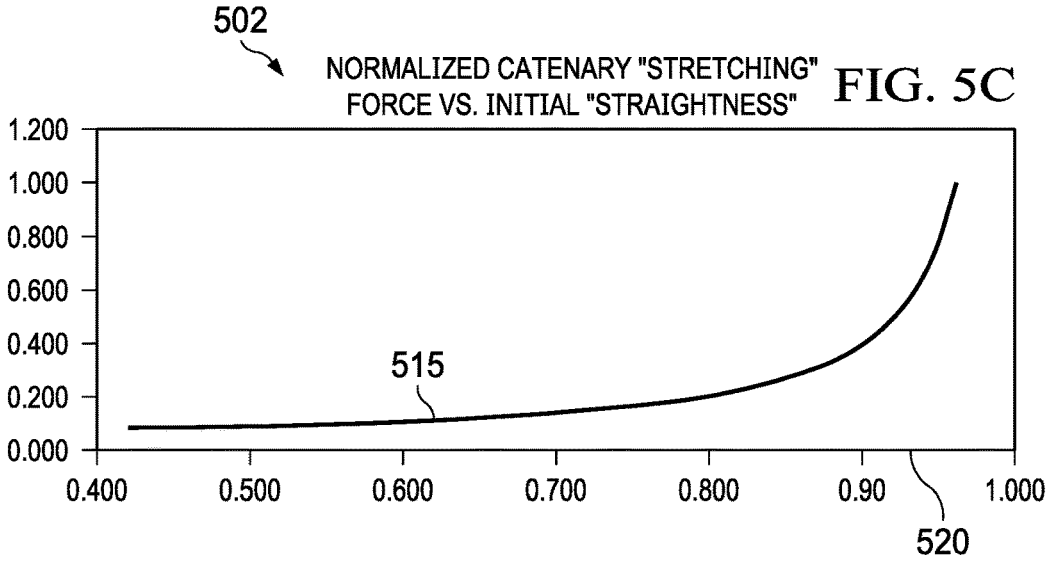
Figure 6A:
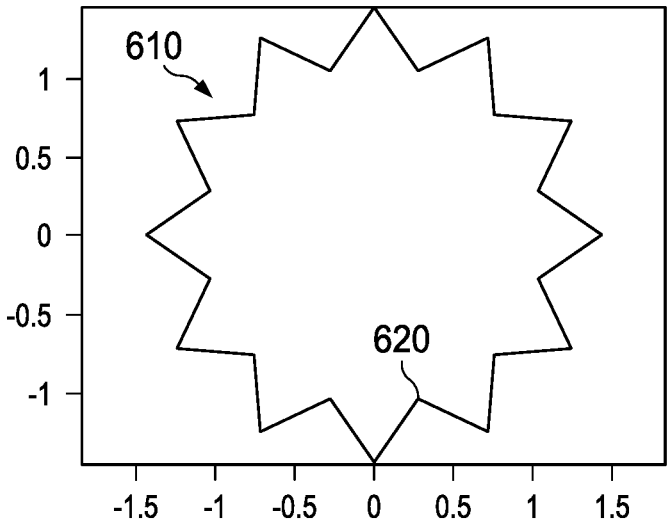
FIGS. 6A-6E illustrate example graphs of cross sections at different distances from the center plane of a shell according to this disclosure.
Figure 6B:
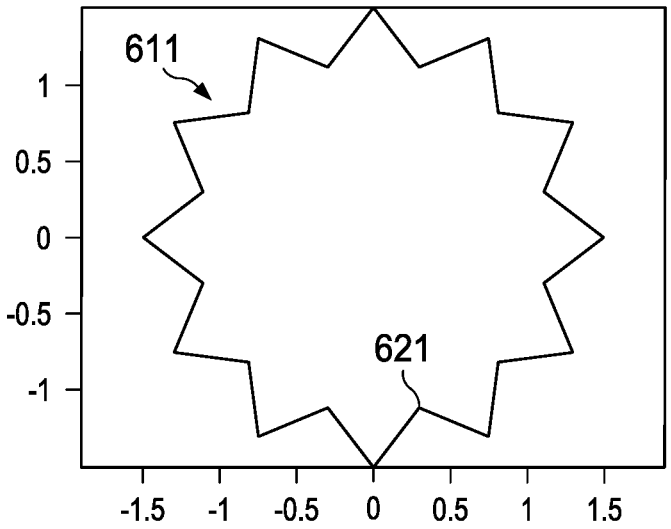
Figure 6C:
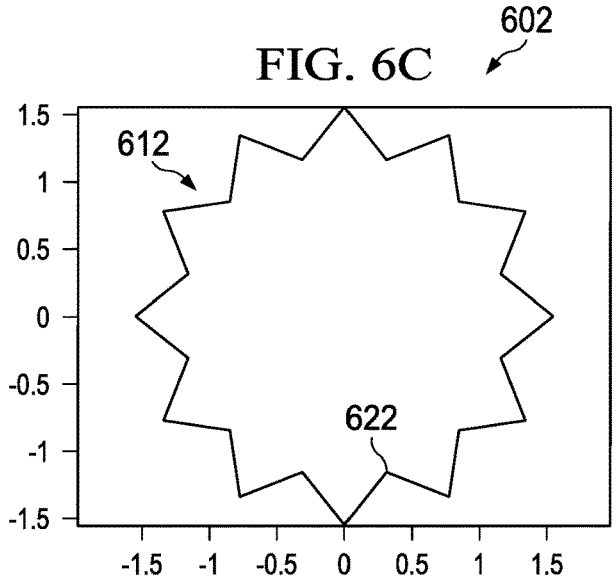
Figure 6D:
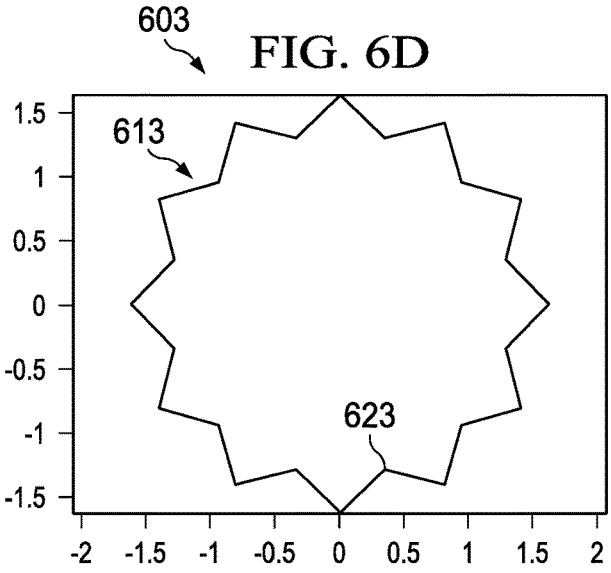
Figure 6E:
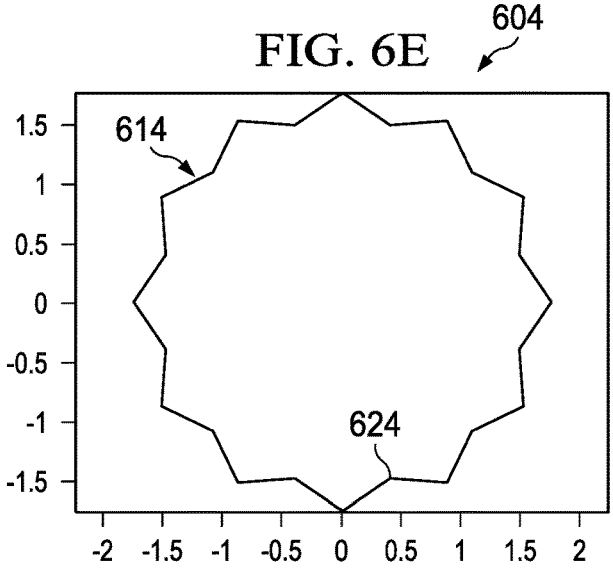

FIGS. 5A, 5B and 5C illustrate an example graph 500 of gamma 505 compared to a ratio of initial midriff radius to shell end outer diameter (droop ratio 520), an example graph 501 of force generation area 510 compared to the droop ratio 520, and an example graph 502 of a catenary stretching force 515 compared to the droop ratio 520 according to this disclosure. The embodiments of the graph 500 of the gamma 505, the graph 501 of the force generation area 510, and the graph 502 of the stretching force 515 illustrated in FIGS. 5A, 5B and 5C are for illustration only. FIGS. 5A, 5B and 5C do not limit the scope of this disclosure to any particular implementation.

The graph 500 illustrates a line comparing the gamma 505 to a "droop ratio", where the droop ratio 520 is a ratio of the initial outer diameter of the midriff to the outer diameter of the end of the shell. If the stretching force 515 could cause the catenary be a straight line, the droop ratio 520 would become 1.0. Gamma 505 is defined as the ratio of a catenary midpoint vertical displacement to a catenary end lateral displacement. "Flattening" curvature of the catenary 510 results in better values of gamma, but also increases the amount of force to drive such a geometry. The acoustic loading also increases dramatically based on "flattening" the curvature of the catenary 510.

At different starting points, the gamma 505 increases as either the starting point between supports increases or the droop ratio 520 increases. Ideally, the shell would have supports are far apart as possible, providing as little droop as possible. But a problem with increasing the distance between supports or the droop ratio 520 requires an increasing force generation area 510 required to drive the geometry. The force generation area 510 limits the droop ratio 520 and the distance between supports. To effectively drive a flatter shell, a larger and larger force area would be required. That is, the shell would require more force from the driver to operate at a higher gamma 505 as the supports are further apart. Unfortunately, the space to operate at a larger force area is difficult because drivers with larger power are less available and more costly as "flattening" is increased. An optimum shell shape is likely found where droop ratio FIGS. 6A-6E illustrate example graphs 600-604 of cross sections at different distances from the center plane of a shell according to this disclosure. The embodiments of the graphs 600-604 of midriff cross sections with the same corrugation geometry and perimeter illustrated in FIGS. 6A-6E are for illustration only. FIGS. 6A-6E do not limit the scope of this disclosure to any particular implementation.

Graphs 600-604 illustrate different cross sections across a catenary of a shell. The cross sections are profiles of the shell or a plane perpendicular to the main axis a specified distance from a center plane (x=0). The graphs 600-604 are illustrated with sharp points on the shell, but in reality the inner diameters and outer diameters of perimeters 620-624 are rounded to conform with the properties of a material used. Cross sections 610-614 illustrate the perimeters 620-624 of the shell. The perimeter of the cross sections 610-614 is defined by perimeters 620-624. The perimeter is not a circle around the outside diameters of the cross sections 610-614, with the exception of the perimeter of the shell ends with a constant outer diameter.

Graph 600 illustrates a perimeter 620 of cross section 610 for a shell at the center plane (x=0) with a facet depth of 0.360 and a mean diameter of cross section 610 to end cap outer diameter (endOD) ratio of 0.727. Cross section 610 has an inner diameter of 2.185, an outer diameter of 2.906 and a mean diameter of 2.545.

Graph 601 illustrates a perimeter 621 of cross section 611 for a shell 1.125 units from the center plane (x=1.125) with a facet depth of 0.348 and a mean diameter of cross section 611 to endOD ratio of 0.757. Cross section 611 has an inner diameter of 2.302, an outer diameter of 2.998 and a mean diameter of 2.650.

Graph 602 illustrates a perimeter 622 of cross section 612 for a shell 1.6875 units from the center plane (x=1.6875) with a facet depth of 0.331 and a mean diameter of cross section 612 to endOD ratio of 0.795. The cross section 612 has an inner diameter of 2.451, an outer diameter of 3.112 and a mean diameter of 2.782.

Graph 603 illustrates a perimeter 623 of cross section 613 for a shell 2.250 units from the center plane (x=2.250) with a facet depth of 0.301 and a mean diameter of cross section 613 to endOD ratio of 0.848. Cross section 613 has an inner diameter of 2.667, an outer diameter of 3.270 and a mean diameter of 2.968.

Graph 604 illustrates a perimeter 622 of cross section 614 for a shell 3.000 units from the center plane (x=3.000) with a facet depth of 0.228 and a mean diameter of cross section 614 to endOD ratio of 0.942. Cross section 614 has an inner diameter of 3.070, an outer diameter of 3.526 and a mean diameter of 3.298.

At the point 3.75 units from the center plane (x=3.750), the perimeter would be a circle. The shell is geometrically defined by having a constant perimeter across the length of the shell. In other words, the perimeters 620-624 are the same for each cross section 610-614 of graphs 600-604. While the depth of the facets for each cross section 610-614 decreases moving along the catenary away from the center plane, the perimeter remains constant through the end caps.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," or "system" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A shell for a transducer comprising:

a first shell end and a second shell end structured with circular cross-sections perpendicular to a main axis of the shell; and a pleated geometry between the first shell end and the second shell end, wherein a length of a perimeter of a cross-section of the pleated geometry perpendicular to the main axis of the shell is the same as a length of a perimeter of the circular cross-section of the first shell end and a length of a perimeter of the circular cross-section of the second shell end;

wherein the shell is formed of a composite material with fibers arranged with a dominant orientation in an axial direction.

2. The shell of claim 1, wherein a longitudinal cross-sectional shape of the pleated geometry is shaped as a catenary or as a portion of a circular arc in a profile of the pleated geometry.

3. The shell of claim 2, wherein the catenary or the portion of the circular arc includes an inner diameter catenary and an outer diameter catenary that is different from the inner diameter catenary for the pleated geometry.

4. The shell of claim 3, wherein the perimeter of the pleated geometry is constant along the main axis of the shell while the inner diameter catenary and the outer diameter catenary vary along the main axis.

5. The shell of claim 1, wherein a ratio of a center plane diameter to a shell end diameter is less than 0.75.

6. The shell of claim 1, wherein the composite material comprises graphite fibers.

7. The shell of claim 1, wherein the composite material comprises fiberglass fibers.

8. The shell of claim 1, wherein the shell is made from a single composite shape.

9. A shell for a transducer comprising:

a first shell end and a second shell end structured with circular cross-sections; and a pleated geometry between the first shell end and the second shell end, wherein a length of a perimeter of the pleated geometry is the same as a length of a perimeter of the circular cross-section of the first shell end and a length of a perimeter of the circular cross-section of the second shell end;

wherein a longitudinal cross-sectional shape of the pleated geometry is shaped as a catenary or as a portion of a circular arc in a profile of the pleated geometry;

wherein the catenary or the portion of the circular arc is optimized based on a gamma value; and wherein the gamma value is a ratio of transverse displacement of a diameter at a center plane compared to an axial displacement of the first shell end.

10. The shell of claim 9, wherein the catenary is further optimized based on a force generation area required for driving the transverse displacement and the axial displacement.

11. An hourglass transducer comprising:

a longitudinal driver configured to drive the hourglass transducer;

a shell for the hourglass transducer, the shell comprising:

a first shell end and a second shell end structured with circular cross-sections perpendicular to a main axis of the shell; and a pleated geometry between the first shell end and the second shell end, wherein a length of a perimeter of a cross-section of the pleated geometry perpendicular to the main axis of the shell is the same as a length of a perimeter of the circular cross-section of the first shell end and a length of a perimeter of the circular cross-section of the second shell end; and a pair of endcaps attached to ends of the longitudinal driver and configured to cap the shell enclosing the hourglass transducer;

wherein the shell is formed of a composite material with fibers arranged with a dominant orientation in an axial direction.

12. The hourglass transducer of claim 11, wherein a longitudinal cross-sectional shape of the pleated geometry is shaped as a catenary or a portion of a circular arc in a profile of the pleated geometry.

13. The hourglass transducer of claim 12, wherein the catenary or the portion of the circular arc includes an inner diameter of the catenary or the portion of the circular arc associated with troughs of pleats and an outer diameter of the catenary or the portion of the circular arc that is different from the inner diameter catenary for the pleated geometry and dependent on a depth of the pleats.

14. The hourglass transducer of claim 13, wherein the perimeter of the pleated geometry is constant along the main axis of the shell while the inner diameter catenary and the outer diameter catenary vary along the main axis.

15. The hourglass transducer of claim 11, wherein a ratio of a center plane diameter to a shell end diameter is less than 0.75.

16. The hourglass transducer of claim 11, wherein the composite material comprises graphite fibers.

17. The hourglass transducer of claim 11, wherein the composite material comprises fiberglass fibers.

18. The hourglass transducer of claim 11, wherein the shell is made from a single composite shape.

19. An hourglass transducer comprising:

a longitudinal driver configured to drive the hourglass transducer;

a shell for the hourglass transducer, the shell comprising:

a first shell end and a second shell end structured with circular cross-sections; and a pleated geometry between the first shell end and the second shell end, wherein a length of a perimeter of the pleated geometry is the same as a length of a perimeter of the circular cross-section of the first shell end and a length of a perimeter of the circular cross-section of the second shell end; and a pair of endcaps attached to ends of the longitudinal driver and configured to cap the shell enclosing the hourglass transducer;

wherein a longitudinal cross-sectional shape of the pleated geometry is shaped as a catenary or as a portion of a circular arc in a profile of the pleated geometry;

wherein the catenary or the portion of the circular arc is optimized based on a gamma value; and wherein the gamma value is a ratio of transverse displacement of a diameter at a center plane compared to an axial displacement of the first shell end.

20. The hourglass transducer of claim 19, wherein the catenary is further optimized based on a force generation area required for driving the transverse displacement and the axial displacement.

* * * * *